United States Patent [19]

Skolnik

[11] Patent Number: 4,906,301

[45] **Date of Patent: * Mar. 6, 1990**

[54] PROCESS OF KOSHERING CONTAINERS

[75] Inventor: Howard B. Skolnik, Chicago, Ill.

[73] Assignee: Skolnik Industries, Inc., Chicago, Ill.

[ * ] Notice: The portion of the term of this patent subsequent to May 16, 2006 has been disclaimed.

[21] Appl. No.: 346,127

[22] Filed: May 2, 1989

Related U.S. Application Data

[63] Continuation-in-part of Ser. No. 131,291, Dec. 8, 1987, Pat. No. 4,830,675.

[51] Int. Cl.[4] ..... B08B 7/00

[52] U.S. Cl. ..... 134/3; 134/2; 134/29; 134/30; 134/40; 134/41

[58] Field of Search ..... 134/2, 3, 40, 30, 41, 134/20; 252/118; 432/124, 225; 110/236

[56] References Cited

U.S. PATENT DOCUMENTS

| | | | |
|---|---|---|---|
| 284,018 | 8/1883 | Hynson | 432/224 |
| 423,496 | 3/1890 | Sherman | 432/224 |
| 433,876 | 8/1890 | Oncken | 432/224 |
| 954,623 | 4/1910 | Grahn | 432/224 |
| 1,052,512 | 2/1913 | Phillips | 432/224 |
| 1,125,930 | 1/1915 | Arnemann | 432/224 |
| 2,254,492 | 9/1941 | Orozco | 134/2 |
| 2,294,168 | 8/1942 | Francis et al. | 134/2 |
| 3,522,093 | 7/1970 | Woolman | 134/2 |
| 4,477,290 | 10/1984 | Carroll et al. | 134/2 |
| 4,518,519 | 5/1985 | Lott et al. | 252/148 |
| 4,599,116 | 7/1986 | King et al. | 134/2 |
| 4,707,191 | 11/1987 | Martinou et al. | 134/3 |
| 4,830,675 | 5/1989 | Skolnik | 134/3 |

*Primary Examiner*—Asok Pal

*Attorney, Agent, or Firm*—Milton S. Gerstein; Marvin N. Benn

[57] ABSTRACT

A process for koshering relatively large metallic containers used to store and transport kosher foods includes the steps of washing and rinsing the interior of the container to remove surface oils and greases, treating the interior surface of the container with a rust inhibitor, flame treating the interior surface to drive off any impregnated oils, greases or dirts and, optionally, spraying the interior of the container with a kosher epoxy/-phenolic compound and thereafter curing the compound by the application of heat. The resulting container may be used to store and transport food stuffs certified to have been prepared in accordance with the kosher dietary laws.

4 Claims, No Drawings

PROCESS OF KOSHERING CONTAINERS

CROSS-REFERENCE TO RELATED APPLICATION

This is a continuation-in-part application of application Ser. No. 07/131,291, filed Dec. 8, 1987, and now U.S. Pat. No. 4,830,675.

BACKGROUND OF THE INVENTION

The present invention relates generally to the processing of manufactured metallic containers and, more particularly, to a process whereby metallic storage containers are processed to allow foods prepared in accordance with the dietary laws of koshering to be stored and transported while retaining the kosher integrity of the food.

The strict dietary laws by which it is determined that foods are kosher require total abstinence from certain foods, prohibit the mixing of certain types of food on a single plate or at a single meal, and also prescribe the manner in which an animal, in order to be considered kosher, must be raised, butchered, and cooked. For example, according to Mosaic Law, certain foods such as pork products and shrimp are inherently not kosher and cannot be prepared to render them kosher. It is also a requirement of the dietary laws that meat dishes and dairy dishes cannot be consumed together, so that otherwise kosher foods, if improperly combined in a single meal will render the meal non-kosher even though the individual components themselves are prepared according to the laws of kosher.

When a vessel, such as a cooking pot, is used to prepare a meat dish, and must thereafter be used to prepare a dairy dish, the vessel must be cleaned thoroughly enough to remove all vestiges of the previously prepared meat dish, such as by the use of boiling water, steam, or flame drying. To my knowledge, there has been no practical method developed to date to adapt such a koshering process to large-volume containers, such as 55 gallon drums. If, for example, the food to be stored is "dairy" in nature, the presence of any contaminant traceable back to a "meat" origin may destroy the kosher character of the food. In like fashion, any "non-kosher" contaminant may also produce the same result.

Problems can then arise when, after food has been prepared in a kosher manner, it is stored in such a way that the storage vessel becomes a vehicle for contaminants which, while not adulterating the food in a medically harmful sense may still contribute contaminants of a character sufficient to destroy the kosher integrity of the food.

As an example, certain metallic containers, such as cans or drums used for the bulk storage and transportation of foods may, during the manufacturing process, may come in contact with, and be coated with a thin film of oil or grease, the presence of which in an otherwise kosher food may destroy the integrity of the koshering process.

Foods prepared in accordance with the dietary laws are certified as kosher by one trained to observe the entire manufacturing process and determine whether the method of preparing the food and the individual ingredients are consistent with the practice and observance of the dietary laws. In much the same manner, the same determination must be made with respect to the preparation of packaging for the food so prepared.

One of the objects of the present invention is to provide a process whereby the carrying out of the process will render a container fit for the storage and transportation of kosher foods without requiring that each such container be chemically tested or inspected to assure that all contaminants have been removed. It thus becomes unnecessary to determine whether or not the particular adulterant present would render any food in the container non-kosher: It is enough that the process remove all such adulterants, whatever their nature.

There is known as part of the prior art a number of issued U.S. patents which relate to the cleaning and treatment of vessels, although no such reference addresses the particular problems inherent in the koshering of such vessels.

U.S. Pat. No. 2,383,470, issued to Morgan on Aug. 28, 1945 describes methods and apparatus for cleaning and surface coating a glass, metallic, or other support surface to which a reflective layer is to be added. The problem addressed by Morgan is the cleaning of the surface and the maintaining of the surface in a clean condition so that the later-applied reflective coating will not "pit". To accomplish this, Morgan teaches the washing of the surface in question with a mineral acid solution, rinsing the surface with distilled water, treating the surface with a flame such as a gas burner, and exposing the surface to the vapors of a suitable organic liquid to produce a protective film on the cleaned surface. The deposited vapor layer is intended to keep the surface clean until the permanent coating is applied. Morgan also discloses a permanent coating a metallized layer intended to impart light-reflecting capabilities to the finished article. Before applying the permanent coating, the vapor deposited organic coating must first be removed.

U.S. Pat. No. 4,136,217 to Henley teaches and describes a continuous process for the removal of oil emulsions from metallic surfaces by washing the surfaces with a mixture of wash water and demulsifier to break up and remove the oil.

U.S. Pat. No. 3,522,093 issued to Wolman on July 28, 1970 teaches the purging and cleaning of the tube surfaces of the tube-and-shell reactors by circulating a cleaning solution through the tubes, purging the tubes with nitrogen, circulating a second solution to passivate clean surfaces and again purging the tubes with nitrogen and retaining nitrogen in the tubes until the tubes are ready for use.

U.S. Pat. No. 3,132,975 issued to Freud issued on May 12, 1964 teaches yet another passivating technique for the metallic surfaces of reactor tubes.

U.S. Pat. No. 3,030,238, issued to Cohn on Apr. 17, 1962 teaches a method for treating metal surfaces involving cleaning the surface to degrease it, rinsing the surface with water and applying a thin residual film on the metal surfaces so cleaned in order to passivate them.

U.S. Pat. No. 4,169,187 issued to Glazer on Sept. 25, 1979, and U.S. Pat. No. 4,163,812 issued to Coucher on Aug. 7, 1979 both teach the coating of cylindrical containers with resinous or epoxy-resinous coatings.

The above mentioned patents do not address the problems inherent in the preparation of a container for the storage and transportation of kosher foods and the techniques and process involved would raise other problems in considering the koshering packing of foods. As an example, the temporary passivating of a metallic surface with a substance intended to thereafter have to be removed may raise a question as to whether or not enough of the substance has been removed in order to render the container safe for kosher packaging.

Accordingly, the need exists for a manufacturing process of treatment which may be applied to and used upon metallic food storage containers to assure that kosher foods placed in such containers will contain their kosher character by avoiding contaminants encountered during the manufacture of the container.

SUMMARY OF THE INVENTION

There is disclosed herein, in varying scope, a process for the koshering of a manufactured metal container, with the process being intended to put the interior of the container into a proper condition for accepting and storing food prepared according to the kosher dietary laws while maintaining the integrity of the food preparation process. A preferred embodiment of the process includes the following steps:

(1) Washing the interior surface of the metal container with an alkaline wash or cleanser at a high enough temperature and for a period sufficient to effect removal of any grease, oil or similar contaminants therefrom;

(2) Rinsing the interior of the container with fresh water for a time sufficient to flush away any remaining cleanser:

(3) Coating the interior surface of the container with a rust inhibitor;

(4) Flame-drying of the interior surface of the container at a sufficient temperature to remove any impregnated oil from pores in the container surface;

(5) Spraying the interior surface of the container with an epoxy-phenolic composition to provide a kosher surface coating; and (6) Baking the epoxy-phenolic coating until the coating is cured.

DETAILED DESCRIPTION OF THE INVENTION

While use of the processes and techniques disclosed herein may be extended to containers of varying sizes and configurations, a preferred use of the presently-described process is directly primarily to relatively large containers, such as steel drums having a capacity of about 55 gallons. Such drums are typically cylindrical in shape and have lids which may be either strapped, crimped, or otherwise attached to close off the drum. Access to the drum may thereafter be had by removing the lid or through a hole or port formed in the lid.

A preferred embodiment of the present invention features the movement of a metallic drum, intended to be rendered fit for the storage and transportation of kosher foods past various processing stations, utilizing well-known techniques of material handling and transportation, such as conveyor belts and the like. The individual stations involved in the process are each specially modified to accommodate the operation carried out at each station and the material being applied to the drum at each station.

A drum selected for treatment will be transported to a first station whereat the interior of the drum is washed with an aqueous solution of a selected detergent or detergents for the removal of any residual grease or oils remaining in or on the steel used to manufacture the drum. One such detergent found to be of particular effectiveness is sold under the tradename "Liquid Ferror-Terj", manufctured by the DuBois Chemical Company of Cincinnati, Ohio. It has also been found, in order to be even more effective, the washing operation should be carried out at a water temperature at or in excess of 160° F.

Most commonly, the greases or oils to be removed will have been applied to the steel while it is still in a flat, sheet configuration prior to manufacturing and may also include dirts, oils, greases, and other surface contaminants encountered during the manufacture, storage, shipment and handling of such flat sheet steel. The present process for producing a kosher container also contemplates the purchase of steel in sheet form and the manufacturer of the drum itself such that every detail of the manufacture and koshering process is carried out in a single facility and such that each step of manufacture and treatment is monitored.

The first, or washing station should preferably include means for the recovery, treatment and recycling of the wash water and the possible separation therefrom of the grease removed from the manufactured drum.

The newly washed drum next will be transferred to a second or rinse station where water is used to remove any remaining vestiges of detergent ad contaminant. In order to increase the efficiency of the rinse process, a sheeting agent or wetting agent is used in connection with the rinse water. One such agent found to be effective is sold under the tradename "Dry-It", manufactured by the DuBois Chemical Company of Cincinnati, Ohio. It has also been found in order to be effective, the rinsing operation should be carried out at a temperature at or in excess of 90° F. As with the wash station, the rinse station should preferably include facilities to capture and recirculate the rinse water utilized, if desired, as well as facilities to separate out the contaminants removed in the rinse water.

At the third, or rustproofing station, a rust inhibitor is applied to the interior surface of the drum in order to prevent the formation of rust on the newly-cleaned and exposed metallic interior surface of the drum. One rust inhibitor found to be of particular utility is sold under the trade designation "R-A-573" by Chemical Systems, Inc. of Chicago, Ill. The application of the rust inhibitor is preferably carried out for about three minutes at a temperature of about 160° F.

After the drum has thus been washed and rinsed, it is transported to a fourth station for flame-treatment of the interior surface. An open flame is used and provided by a conventional flame-burner which drives out any remaining contaminants which may have infiltrated the porous surface of the sheet steel used to form the drum. Such flame treatment is a typical step in the koshering of cooking vessels used to prepare different types of foods at different times, the combination of which in the same vessel would produce a nonkosher food mixture. Again, the flame-drying should be carried out for a sufficient length of time to assure that any such entrained contaminants, whether or not detectable to the human eye, be removed. In the preferred embodiment, the flame-drying is carried out within a range of temperatures of the flames between 600 degrees F. and 1300 degrees F. In the preferred embodiment, the length of flame-exposure of the hollow interior of the drum to the flames is between two seconds for the upper range of temperature, and up to 30 seconds for the lower range thereof, it being understood that the flame-temperature and flame-exposure time is variable depending upon the size of the drum or container, preferred operating temperature of the flames, and the speed of any conveyor system used therefor, and the like. In the preferred embodiment, this process step may be used alone without any other stated herein, except for, perhaps, washing or rinsing after said step of flame-drying, the flame-drying step alone, in more cases and circumstances, providing a kosher container according to Jewish law, with the washing and rinsing removing the ash, burned residue, and the like. The washing and rinsing after the step of flame-drying may be the same as the first and second steps performed at the first and second stations, so that after the step of flame-drying, the flame-treated drum may thereafter be returned to the very same first and second stations. Alternatively, the flame-treating step may be carried out first, with the washing and rinsing steps carried out thereafter. What is essential is that the step of flame-treating the interior of the drum be carried out, with the washing and rinsing, as well as third rust-proofing step, although desirable, being optional before the flame-treating step, as well as after, though for all intents and purposes, washing and rinsing after the step of flame-treating is preferred in order to rid the interior of the drum from ash, etc., as explained above. The last, coating step, described below, is also optional, and may be eliminated.

At the fifth processing station, an epoxy/phenolic composition is applied to the inner surface of the drum in order to produce a kosher coating. The particular epoxy/phenolic combination is selected to be kosher within the dietary laws, and one such phenolic coating found effective is sold under the trade designation "285-C-124 (tan color)" or "285-R-114 (dark brown color)" by the Valspar Corporation of Baltimore, Md.

At the last processing station, the drum is baked at a temperature of about 425° F. until the epoxy/phenolic coating is fully cured.

The above-described process forms an integral part of the manufacturing and distribution chain of kosher foods. Manufacturers of such foods must verify that the foods are in a kosher condition upon final preparation. Thereafter, the kosher character and quality of the container itself must also be certifiable in order to assure that subsequent storage and transportation of the foods will not compromise its kosher character and quality.

While the foregoing has presented a specific preferred embodiment of the invention disclosed herein, it is to be understood that this embodiment has been presented by way of example only. It is expected that others will perceive variations which, while different from the foregoing, do not depart from the spirit and scope of the invention as herein described and claimed.

What I claim is:

1. A process for koshering of metallic food storage containers, said containers manufactured from flat sheet steel on whose interior surface oils, greases, and dirt are suspected of being present, said process comprising the stepsof:

(a) washing the interior of said container with a degreasing detergent in an aqueous solution;

(b) rinsing the interior of said container with a water wash after said step of washing;

(c) removing oils, grease and other contaminants entrained within the pores of and on said interior surface by exposing said surface to a flame;

(d) said step (c) comprising exposing said interior surface to a flame for a sufficient length of time in order to carry out said step (c);

(e) applying to the interior surface of said container an epoxy/phenolic composition containing no non-kosher ingredients after said step (a); and (f) applying heat to the interior of said container to cure said epoxy/phenolic coat.

2. The process according to claim 1, wherein said step (d) comprises:

(g) passing said hollow interior over an exposed flame-burner so that the flames of the flame-burner may enter into said hollow interior for contacting said interior surface thereof.

3. The process according to claim 2, further comprising repeating said step (g) a multitude of times in succession, said step of repeating comprising conveying a plurality of containers over the exposed flame-burner one after the other.

4. The process according to claim 1, further comprising:

adjusting the flame to a desired flame-temperature and flame-height, so that different sizes of containers may be processed and flame-drying times altered.

* * * * *